US011715430B2

(12) United States Patent
Chen et al.

(10) Patent No.: US 11,715,430 B2
(45) Date of Patent: Aug. 1, 2023

(54) BACKLIGHT DRIVING METHOD AND MODULE FOR A SCAN-TYPE DISPLAY

(71) Applicant: MACROBLOCK, INC., Hsinchu (TW)

(72) Inventors: Chang-Lin Chen, Hsinchu (TW); Chun-Yi Li, Hsinchu (TW); Wei-Chung Chen, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 0 days.

(21) Appl. No.: 17/662,722

(22) Filed: May 10, 2022

(65) Prior Publication Data

US 2022/0366860 A1 Nov. 17, 2022

(30) Foreign Application Priority Data

May 13, 2021 (TW) ..... 110117350

(51) Int. Cl.
*G09G 3/34* (2006.01)

(52) U.S. Cl.
CPC ..... *G09G 3/342* (2013.01); *G09G 2310/08* (2013.01)

(58) Field of Classification Search
CPC ..... G09G 3/342; G09G 2310/08
See application file for complete search history.

(56) References Cited

U.S. PATENT DOCUMENTS 6,243,067 B1 * 6/2001 Noguchi ..... G09G 3/3406 345/88
11,132,960 B1 * 9/2021 Wu ..... G09G 3/3413
2008/0094344 A1 * 4/2008 Kuroki ..... G09G 3/342 345/102
2022/0366862 A1 * 11/2022 Chen ..... G09G 3/3426
2022/0366863 A1 * 11/2022 Chen ..... G09G 3/3426

* cited by examiner

*Primary Examiner* — Rodney Amadiz
(74) *Attorney, Agent, or Firm* — Akerman LLP; Peter A. Chiabotti

(57) ABSTRACT

A backlight driving method includes steps of: (A) generating an original synchronization control (SC) signal, and a serial input signal that contains multiple predetermined delay values; (B) generating multiple internal SC signals based on the original SC signal and the delay values, such that respective time delays of the internal SC signals with respect to the original SC signal are respectively dependent on the delay values; and (C) generating multiple backlight driving outputs based on the internal SC signals to respectively drive multiple backlight sources, such that the backlight sources emit light in an order dependent on the delay values.

11 Claims, 5 Drawing Sheets

BACKLIGHT DRIVING METHOD AND MODULE FOR A SCAN-TYPE DISPLAY

CROSS-REFERENCE TO RELATED APPLICATION

This application claims priority of Taiwanese Patent Application No. 110117350, filed on May 13, 2021.

FIELD

The disclosure relates to display driving techniques, and more particularly to a backlight driving method and a backlight driving module for a scan-type display.

BACKGROUND

In a liquid crystal display, light emitted by a backlight module passes through a liquid crystal layer of a liquid crystal panel by a variable amount, and is filtered by a color filter of the liquid crystal panel, so as to produce color images. However, the liquid crystal layer has a long response time, and if all light emitting diodes (LEDs) of the backlight module emit light continuously, motion blur could occur when the liquid crystal display shows moving images.

SUMMARY

Therefore, an object of the disclosure is to provide a backlight driving method and a backlight driving module for a scan-type display. The backlight driving method and the backlight driving module can alleviate motion blur.

According to an aspect of the disclosure, the backlight driving method is to be implemented by a backlight driving module of a scan-type display, and is adapted to drive a backlight module of the scan-type display. The backlight module includes a plurality of backlight sources. The backlight driving method includes steps of: (A) generating an original synchronization control signal and a serial input signal; the original synchronization control signal being related to refreshing of image frames on the scan-type display; the serial input signal containing an image stream and a plurality of predetermined delay values; (B) generating a plurality of internal synchronization control signals based on the original synchronization control signal and the predetermined delay values, such that a time delay of each of the internal synchronization control signals with respect to the original synchronization control signal is dependent on a respective one of the predetermined delay values; and (C) generating a plurality of backlight driving outputs based on the image stream and the internal synchronization control signals and outputting the backlight driving outputs respectively to the backlight sources, such that the backlight sources emit light in an order dependent on the predetermined delay values, and brightness of the backlight module is dependent on the image stream.

According to another aspect of the disclosure, the backlight driving module is adapted to be installed in a scan-type display to drive a backlight module of the scan-type display. The backlight module includes a plurality of backlight sources. The backlight driving module includes a plurality of backlight drivers that are adapted to be respectively coupled to the backlight sources. Each of the backlight drivers receives an original synchronization control signal and a serial input signal. The original synchronization control signal is related to refreshing of image frames on the scan-type display. The serial input signal contains an image stream and a plurality of predetermined delay values. Each of the backlight drivers generates an internal synchronization control signal based on the original synchronization control signal and a respective one of the predetermined delay values, such that a time delay of the internal synchronization control signal with respect to the original synchronization control signal is dependent on the respective one of the predetermined delay values. Each of the backlight drivers further generates a backlight driving output based on the image stream and the internal synchronization control signal and outputs the backlight driving output to the backlight source coupled to the backlight driver, such that the backlight sources emit light in an order dependent on the predetermined delay values, and brightness of the backlight module is dependent on the image stream.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
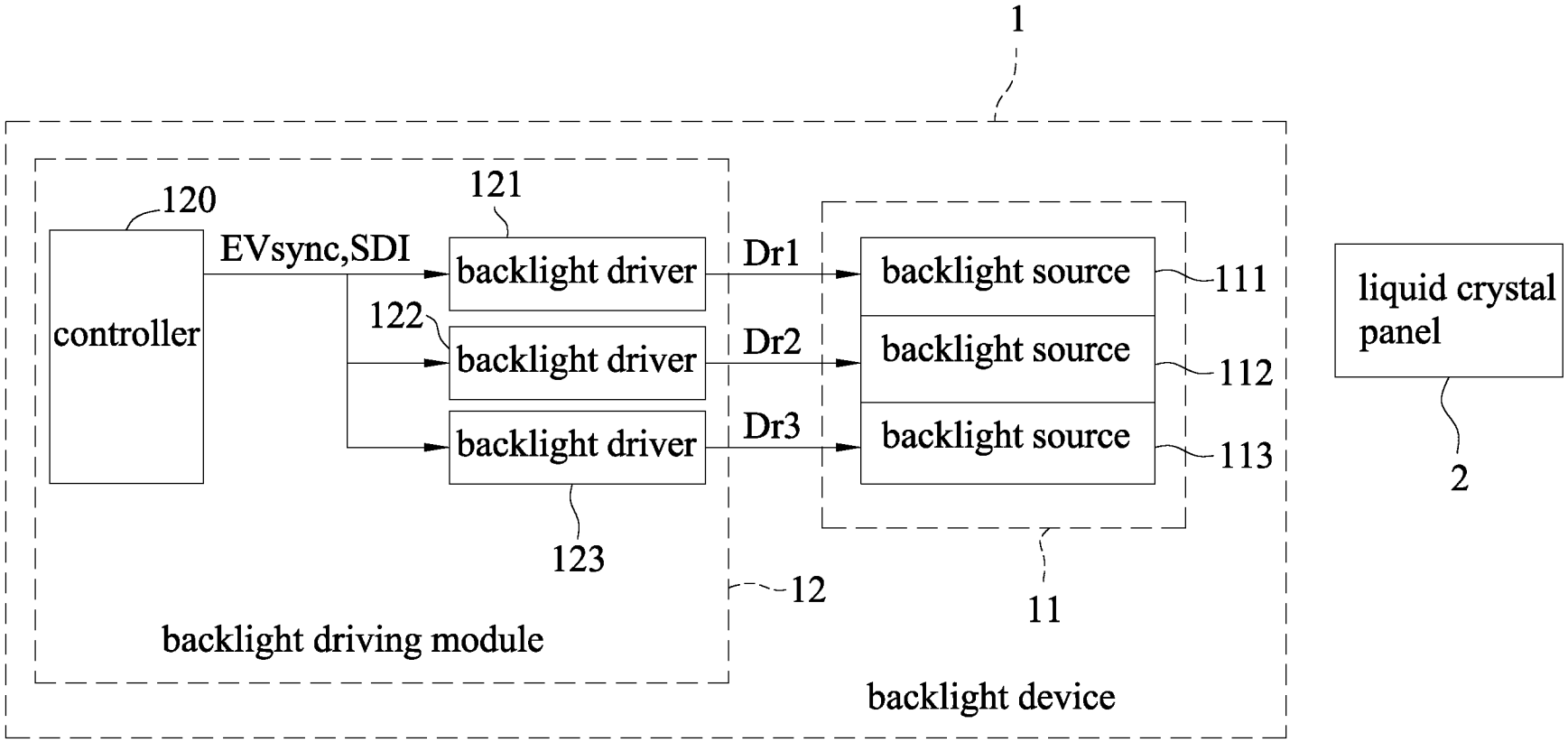
FIG. 1 is a block diagram illustrating an embodiment of a backlight driving module according to the disclosure.

Referring to FIGS. 1 to 4, an embodiment of a backlight driving module 12 according to the disclosure is adapted to be installed in a scan-type display. In this embodiment, the scan-type display is a liquid crystal display, supports dynamic frame rate technologies, and includes a backlight device 1 and a liquid crystal panel 2. The backlight device 1 includes a backlight module 11. The backlight driving module 12 of this embodiment is adapted to be installed in the backlight device 1, and performs a backlight driving method so as to drive the backlight module 11 to emit light.

The backlight module 11 includes a plurality of backlight sources (e.g., three backlight sources 111-113 in this embodiment) that are arranged in parallel with one another. Each of the backlight sources 111-113 includes a plurality of switches (not shown), and a light emitting diode (LED) array (not shown) that includes a plurality of LEDs. The configuration of each of the backlight sources 11 is known to those skilled in the art, and other details thereof are omitted herein for the sake of brevity.

The backlight driving module 12 of this embodiment includes a controller 21 and a plurality of backlight drivers (e.g., three backlight drivers 121-123 in this embodiment). It should be noted that each of the backlight drivers 121-123 is fabricated as a single integrated circuit in this embodiment. In addition, while the controller 120 is included in the backlight driving module 12 in this embodiment, it may be independent of the backlight driving module 12 in other embodiments.

The controller 21 is configured to generate a serial input signal (SDI) and an original synchronization control signal (EVsync). The serial input signal (SDI) contains a plurality of predetermined delay values (three predetermined delay values in this embodiment) and an image stream. A total number of the predetermined delay values is equal to a total number of the backlight sources 111-113. All of the predetermined delay values may be the same, or at least two of the predetermined delay values may be different from each other. The image stream is generated by a graphics processing unit (GPU) (not shown) of the controller 120, and contains multiple pieces of image data that respectively correspond to multiple image frames (images of multiple frames of the image stream) to be shown by the scan-type display. Each piece of image data includes a plurality of data segments (three data segments in this embodiment). Each image frame includes a plurality of frame segments (three frame segments in this embodiment) that respectively correspond to the data segments of the corresponding piece of image data. The original synchronization control signal (EVsync) is related to refreshing of image frames on the scan-type display (i.e., an act of the scan-type display switching from displaying a current image frame to displaying a next image frame). In this embodiment, light transmittance of the liquid crystal panel 2 varies according to the image stream, and light emitted by the backlight module 11 is modulated by the liquid crystal panel 2 to produce the image frames related to the image stream.

Each of the backlight drivers 121-123 is coupled to the controller 120 to receive the serial input data (SDI) and the original synchronization control signal (EVsync), and is adapted to be further coupled to a respective one of the backlight sources 111-113. Each of the backlight drivers 121-123 generates an internal synchronization control signal (IVsync1/IVsync2/IVsync3) based on the original synchronization control signal (EVsync) and a respective one of the predetermined delay values, such that a time delay of the internal synchronization control signal (IVsync1/IVsync2/IVsync3) with respect to the original synchronization control signal (EVsync) is dependent on the respective one of the predetermined delay values. Each of the backlight drivers 121-123 further generates a backlight driving output (Dr1/Dr2/Dr3) based on the image stream and the internal synchronization control signal (IVsync1/IVsync2/IVsync3) and outputs the backlight driving output (Dr1/Dr2/Dr3) to the backlight source 111/112/113 coupled to the backlight driver 121/122/123, such that the backlight sources 111-113 emit light in an order dependent on the predetermined delay values, and brightness of the backlight module 11 is dependent on the image stream.

For example, the backlight driver 121 is coupled to the backlight source 111, delays the original synchronization control signal (EVsync) by a delay time dependent on a first one of the predetermined delay values so as to generate the internal synchronization control signal (IVsync1), and generates the backlight driving output (Dr1) based on the internal synchronization control signal (IVsync1) and a first one of the data segments of any piece of image data of the image stream. The backlight driver 122 is coupled to the backlight source 112, delays the original synchronization control signal (EVsync) by a delay time dependent on a second one of the predetermined delay values so as to generate the internal synchronization control signal (IVsync2), and generates the backlight driving output (Dr2) based on the internal synchronization control signal (IVsync2) and a second one of the data segments of any piece of image data of the image stream. The backlight driver 123 is coupled to the backlight source 113, delays the original synchronization control signal (EVsync) by a delay time dependent on a third one of the predetermined delay values so as to generate the internal synchronization control signal (IVsync3), and generates the backlight driving output (Dr3) based on the internal synchronization control signal (IVsync3) and a third one of the data segments of any piece of image data of the image stream.

It should be noted that each of the backlight driving outputs (Dr1-Dr3) includes a plurality of switching signals for respectively switching the switches of the corresponding backlight source 111/112/113 between conduction and non-conduction, and a plurality of driving signals for adjusting brightness of the LED array of the corresponding backlight source 111/112/113. The composition of each of the backlight driving outputs (Dr1-Dr3) is known to those skilled in the art, and other details thereof are omitted herein for the sake of brevity. In addition, the controller 120 outputs the serial input signal (SDI) and the original synchronization control signal (EVsync) to each of the backlight drivers 121-123 in this embodiment, but the disclosure is not limited thereto. For example, in another embodiment, the controller 120 outputs the serial input signal (SDI) and the original synchronization control signal (EVsync) only to the backlight driver 121; then the backlight driver 121 outputs the serial input signal (SDI) and the original synchronization control signal (EVsync) to the backlight driver 122; and finally the backlight driver 122 outputs the serial input signal (SDI) and the original synchronization control signal (EVsync) to the backlight driver 123. In yet another embodiment, the controller 120 outputs the serial input signal (SDI) to each of the backlight drivers 121-123, and outputs the original synchronization control signal (EVsync) only to the backlight driver 121; then the backlight driver 121 outputs the original synchronization control signal (EVsync) to the backlight driver 122; and finally the backlight driver 122 outputs the original synchronization control signal (EVsync) to the backlight driver 123. In still another embodiment, the controller 120 outputs the original synchronization control signal (EVsync) to each of the backlight drivers 121-123, and outputs the serial input signal (SDI) only to the backlight driver 121; then the backlight driver 121 outputs the serial input signal (SDI) to the backlight driver 122; and finally the backlight driver 122 outputs the serial input signal (SDI) to the backlight driver 123.

Figure 2:
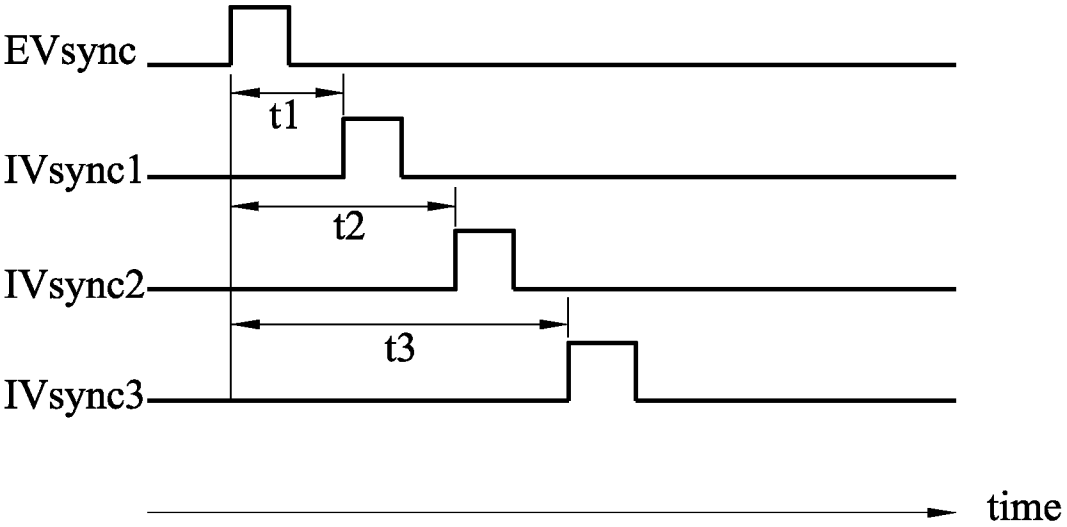
FIG. 2 is a timing diagram illustrating an original synchronization control signal and a plurality of internal synchronization control signals of a first implementation of the embodiment.
Figure 3:
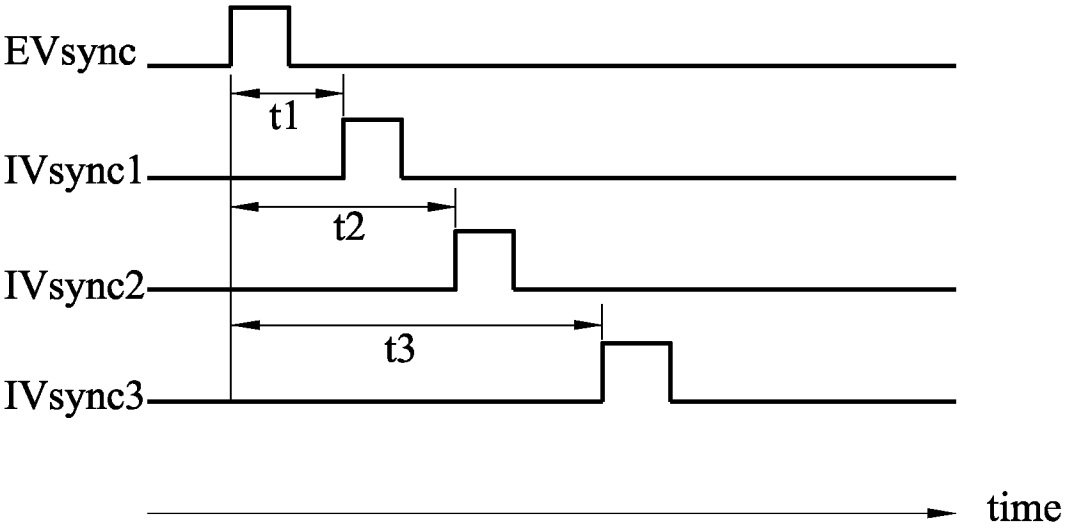
FIG. 3 is a timing diagram illustrating the original synchronization control signal and the internal synchronization control signals of a second implementation of the embodiment.
Figure 4:
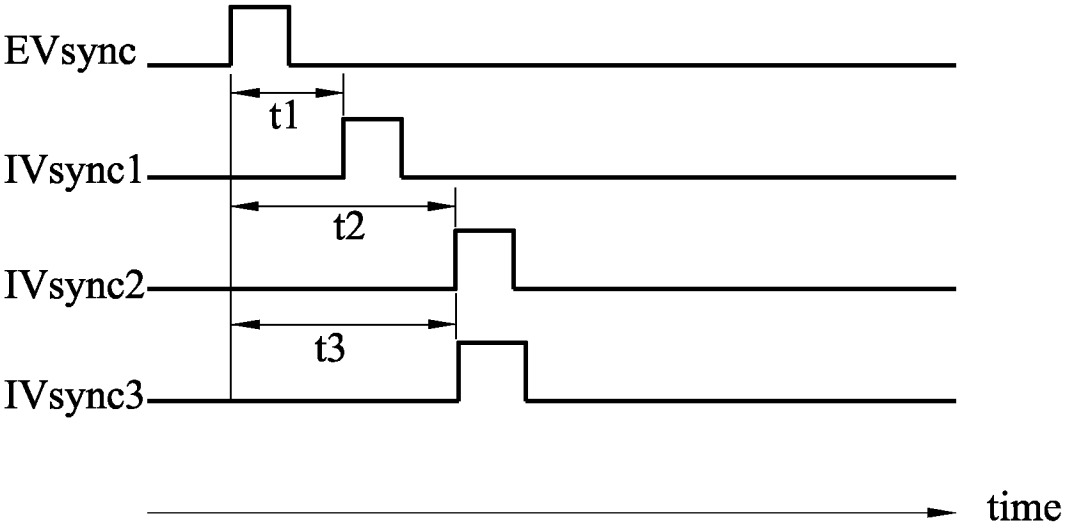
FIG. 4 is a timing diagram illustrating the original synchronization control signal and the internal synchronization control signals of a third implementation of the embodiment.

In this embodiment, as shown in FIGS. 2 to 4, each of the original synchronization control signal (EVsync) and the internal synchronization control signals (IVsync1-IVsync3) respectively generated by the backlight drivers 121-123 is a pulse signal. FIGS. 2 to 4 only depict a pulse of the original synchronization control signal (EVsync), and a pulse of each of the internal synchronization control signals (IVsync1-IVsync3) that corresponds to the pulse of the original synchronization control signal (EVsync). For any one of the internal synchronization control signals (IVsync1-IVsync3), the time delay of the internal synchronization control signal (IVsync1/IVsync2/IVsync3) with respect to the original synchronization control signal (EVsync) is a time interval (t1/t2/t3) between a starting point of the pulse of the original synchronization control signal (EVsync) and a starting point of the corresponding pulse of the internal synchronization control signal (IVsync1/IVsync2/IVsync3), and is determined by the corresponding predetermined delay value (e.g., being equal to a product of the corresponding predetermined delay value and a predetermined time length). In a first implementation of this embodiment as shown in FIG. 2, the predetermined delay values form an arithmetic progression with a positive common difference, so a difference between the time intervals (t1, t2) is equal to a difference between the time intervals (t2, t3). In a second implementation of this embodiment as shown in FIG. 3, the predetermined delay values form a strictly monotonically increasing sequence, and differences between each two adjacent ones of the predetermined delay values are different from one another, so the difference between the time intervals (t1, t2) is different from the difference between the time intervals (t2, t3). In a third implementation of this embodiment as shown in FIG. 4, at least two of the predetermined delay values are equal to each other. For example, the first one of the predetermined delay values is smaller than the second one of the predetermined delay values, and the second one of the predetermined delay values is equal to the third one of the predetermined delay values, so the difference between the time intervals (t1, t2) is non-zero, and the difference between the time intervals (t2, t3) is zero.

In this embodiment, each of the backlight driver 121-123 generates the corresponding backlight driving output (Dr1/Dr2/Dr3) in such a way that the corresponding backlight source 111/112/113 starts to emit light in a line scan manner (i.e., the LED array of the corresponding backlight source 111/112/113 emitting light row by row without overlapping one another in time) for a predetermined time period upon appearance of each pulse of the corresponding internal synchronization control signal (IVsync1/IVsync2/IVsync3).

Figure 5:
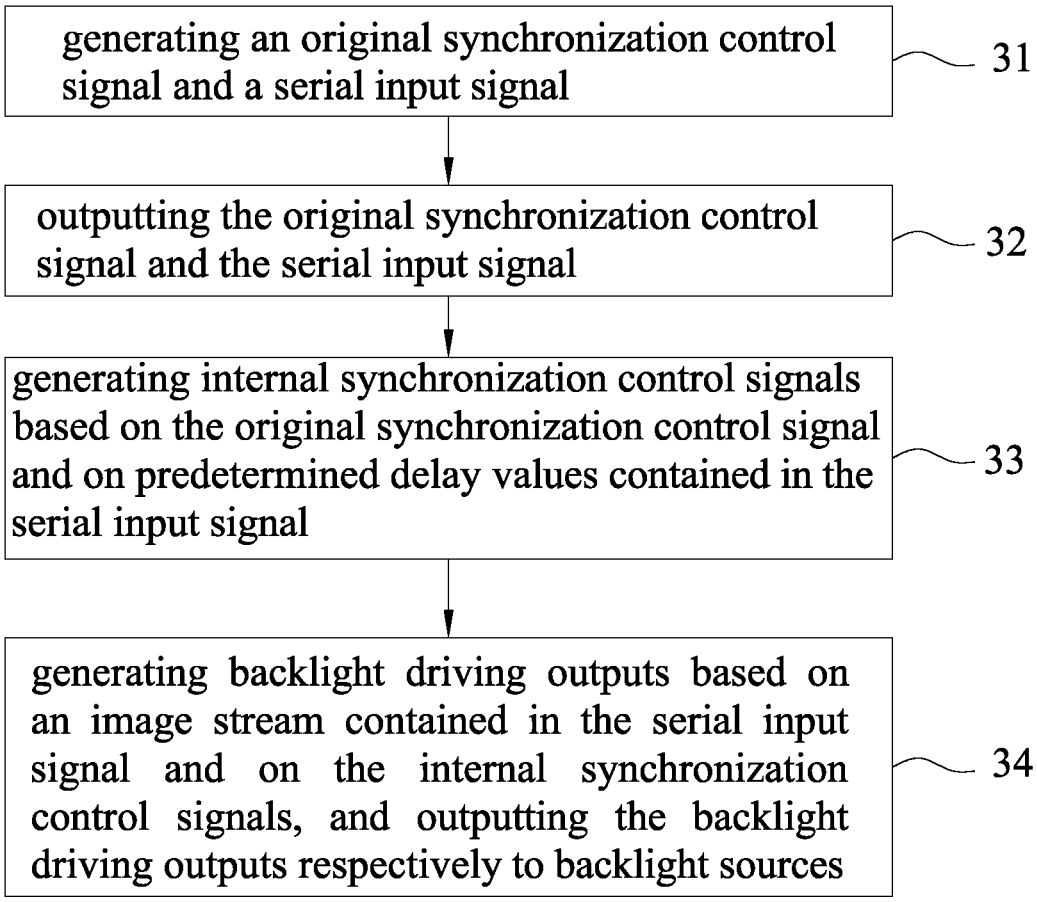
FIG. 5 is a flow chart illustrating a backlight driving method performed by the embodiment.

Referring to FIGS. 1, 2 and 5, in this embodiment, the backlight driving module 12 performs the backlight driving method that includes steps 31-34, so as to drive the backlight sources 111-113 to emit light.

In step 31, the controller 120 generates the original synchronization control signal (EVsync) and the serial input signal (SDI).

In step 32, the controller 21 outputs the original synchronization control signal (EVsync) and the serial input signal (SDI) to each of the backlight drivers 121-123.

In step 33, each of the backlight drivers 121-123 generates the corresponding internal synchronization control signal (IVsync1/IVsync2/IVsync3) based on the original synchronization control signal (EVsync) and the corresponding predetermined delay value.

In step 34, each of the backlight drivers 121-123 generates the corresponding backlight driving output (Dr1/Dr2/Dr3) based on the image stream and the corresponding internal synchronization control signal (IVsync1/IVsync2/IVsync3) and outputs the corresponding backlight driving output (Dr1/Dr2/Dr3) to the corresponding backlight source 111/112/113, so as to drive the corresponding backlight source 111/112/113 to emit light.

In view of the above, in this embodiment, by virtue of the backlight driving module 12 performing the backlight driving method, the backlight sources 111-113 emit light in an order that is dependent on the predetermined values, instead of all emitting light continuously. Therefore, motion blur can be alleviated and display quality can be enhanced when the scan-type display shows moving images.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A backlight driving method to be implemented by a backlight driving module of a scan-type display, and adapted to drive a backlight module of the scan-type display; the backlight module including a plurality of backlight sources; said backlight driving method comprising steps of:

(A) generating an original synchronization control signal and a serial input signal; the original synchronization control signal being related to refreshing of image frames on the scan-type display; the serial input signal containing an image stream and a plurality of predetermined delay values;

(B) generating a plurality of internal synchronization control signals based on the original synchronization control signal and the predetermined delay values, such that a time delay of each of the internal synchronization control signals with respect to the original synchronization control signal is dependent on a respective one of the predetermined delay values; and (C) generating a plurality of backlight driving outputs based on the image stream and the internal synchronization control signals and outputting the backlight driving outputs respectively to the backlight sources, such that the backlight sources emit light in an order dependent on the predetermined delay values, and brightness of the backlight module is dependent on the image stream.

2. The backlight driving method of claim 1, wherein, in step (B):

the original synchronization control signal and each of the internal synchronization control signals are pulse signals; and for any one of the internal synchronization control signals, the time delay of the internal synchronization control signal with respect to the original synchronization control signal is a time interval between a starting point of a pulse of the original synchronization control signal and a starting point of a pulse of the internal synchronization control signal that corresponds to the pulse of the original synchronization control signal.

3. The backlight driving method of claim 1, wherein:

a total number of the predetermined delay values is no less than two; and the predetermined delay values form an arithmetic progression with a positive common difference.

4. The backlight driving method of claim 1, wherein:

a total number of the predetermined delay values is no less than two;

the predetermined delay values form a strictly monotonically increasing sequence; and differences, between each two adjacent ones of the predetermined delay values, are different from one another.

5. The backlight driving method of claim 1, wherein at least two of the predetermined delay values are equal to each other.

6. A backlight driving module adapted to be installed in a scan-type display to drive a backlight module of the scan-type display; the backlight module including a plurality of backlight sources; said backlight driving module comprising:

a plurality of backlight drivers adapted to be respectively coupled to the backlight sources;

each of said backlight drivers receiving an original synchronization control signal and a serial input signal; the original synchronization control signal being related to refreshing of image frames on the scan-type display; the serial input signal containing an image stream and a plurality of predetermined delay values;

each of said backlight drivers generating an internal synchronization control signal based on the original synchronization control signal and a respective one of the predetermined delay values, such that a time delay of the internal synchronization control signal with respect to the original synchronization control signal is dependent on the respective one of the predetermined delay values;

each of said backlight drivers further generating a backlight driving output based on the image stream and the internal synchronization control signal and outputting the backlight driving output to the backlight source coupled to said backlight driver, such that the backlight sources emit light in an order dependent on the predetermined delay values, and brightness of the backlight module is dependent on the image stream.

7. The backlight driving module of claim 6, further comprising:

a controller coupled to said backlight drivers, and generating the original synchronization control signal and the serial input signal for receipt by said backlight drivers.

8. The backlight driving module of claim 6, wherein:

each of the original synchronization control signal and the internal synchronization control signals respectively generated by said backlight drivers is a pulse signal; and for any one of the internal synchronization control signals, the time delay of the internal synchronization control signal with respect to the original synchronization control signal is a time interval between a starting point of a pulse of the original synchronization control signal and a starting point of a pulse of the internal synchronization control signal that corresponds to the pulse of the original synchronization control signal.

9. The backlight driving module of claim 6, wherein:

a total number of the predetermined delay values is no less than two; and the predetermined delay values form an arithmetic progression with a positive common difference.

10. The backlight driving module of claim 6, wherein:

a total number of the predetermined delay values is no less than two;

the predetermined delay values form a strictly monotonically increasing sequence; and differences, between each two adjacent ones of the predetermined delay values, are different from one another.

11. The backlight driving module of claim 6, wherein at least two of the predetermined delay values are equal to each other.

* * * * *